US009947266B2

(12) United States Patent
Nakagawa et al.

(10) Patent No.: US 9,947,266 B2
(45) Date of Patent: Apr. 17, 2018

(54) DRIVE CIRCUIT, DISPLAY DEVICE AND DRIVING METHOD

(71) Applicant: Sharp Kabushiki Kaisha, Osaka-shi, Osaka (JP)

(72) Inventors: Yousuke Nakagawa, Osaka (JP); Kazuhiro Maeda, Osaka (JP)

(73) Assignee: Sharp Kabushiki Kaisha, Sakai (JP)

( * ) Notice: Subject to any disclaimer, the term of this patent is extended or adjusted under 35 U.S.C. 154(b) by 404 days.

(21) Appl. No.: 14/651,394

(22) PCT Filed: Dec. 13, 2013

(86) PCT No.: PCT/JP2013/083479

§ 371 (c)(1),
(2) Date: Jun. 11, 2015

(87) PCT Pub. No.: WO2014/097990

PCT Pub. Date: Jun. 26, 2014

(65) Prior Publication Data

US 2015/0325168 A1 Nov. 12, 2015

(30) Foreign Application Priority Data

Dec. 19, 2012 (JP) ..... 2012-277113

(51) Int. Cl.
*G09G 3/32* (2016.01)
*G09G 3/3216* (2016.01)
*G09G 3/3225* (2016.01)

(52) U.S. Cl.
CPC ..... *G09G 3/3216* (2013.01); *G09G 3/3225* (2013.01); *G09G 2300/0852* (2013.01);
(Continued)

(58) Field of Classification Search
CPC ... G09G 2300/0852; G09G 2300/0861; G09G 2320/045; G09G 3/3216; G09G 3/3225
See application file for complete search history.

(56) References Cited

U.S. PATENT DOCUMENTS

2007/0118781 A1 5/2007 Kim
2012/0327108 A1* 12/2012 Kato ..... G09G 3/3233 345/619

FOREIGN PATENT DOCUMENTS

JP 2007-171325 A 7/2007
JP 2007171325 A * 7/2007 ..... G09G 3/20
(Continued)

OTHER PUBLICATIONS

Official Communication issued in International Patent Application No. PCT/JP2013/083479, dated Mar. 18, 2014.

*Primary Examiner* — Latanya Bibbins
(74) *Attorney, Agent, or Firm* — Keating & Bennett, LLP

(57) ABSTRACT

A retention unit which retains input data, and a light emission control unit which compensates a value of a drive current that flows to a light emission element based on the input data which is retained in the retention unit, are provided in each pixel unit of a display device. While the light emission control unit displays input data of an image of an Nth frame during a light emission period TL (N) by driving the light emission element, input data of an image of an (N+1)th frame is written to the retention unit which becomes a pair together with the light emission control unit, as processing in a write processing period TS (N+1) of the (N+1)th frame.

20 Claims, 10 Drawing Sheets

(52) U.S. Cl.
CPC ..... *G09G 2300/0861* (2013.01); *G09G 2320/045* (2013.01)

(56) References Cited

FOREIGN PATENT DOCUMENTS

| | | | | |
|---|---|---|---|---|
| JP | 2007-206589 | A | 8/2007 | |
| JP | 4637070 | B2 | 2/2011 | |
| WO | 2011/077718 | A1 | 6/2011 | |
| WO | WO 2011077718 | A1 * | 6/2011 | ..... G09G 3/3233 |

* cited by examiner

DRIVE CIRCUIT, DISPLAY DEVICE AND DRIVING METHOD

TECHNICAL FIELD

The present invention relates to a drive circuit of a display device, a display device, and driving method.

The present disclosure contains subject matter related to that disclosed in Japanese Priority Patent Application JP 2012-277113 filed in the Japan Patent Office on Dec. 19, 2012, the entire contents of which are hereby incorporated by reference.

BACKGROUND ART

As a driving method of a display device (display panel), a driving method of an active scan type which is suitable for adopting multi-pixels and a high definition is used. In such a display device, the number of data which is written to a display device per unit time tends to increase, according to an increase of the number of pixels caused by adopting multi-pixels and a high definition.

In addition, there is an organic electroluminescence (EL) display as a type of a display device.

An organic EL display adjusts an amount of light of a light emission element which is provided in the respective pixels, and thereby an image is formed and displayed. However, if characteristics (threshold characteristics) of a drive circuit which drives a light emission element are changed, image quality of an image to be displayed is decreased. A technology is known in which, in order to suppress a decrease of the image quality, a drive current of a light emission element is compensated for each pixel according to characteristics of a drive circuit, and thereby a decrease of pixel quality is suppressed (PTL 1).

According to PTL 1, a write processing period and a light emission period of data (input data) to be displayed are provided so as to correspond to a horizontal scan period of each scan line, and an amount of light (brightness of pixel) of the light emission period is controlled, based on data which is written during the write processing period. Compensation for suppressing a decrease of image quality and according to characteristics (threshold characteristics) of a drive circuit is performed during the write processing period.

CITATION LIST

Patent Literature

PTL 1: Japanese Patent No. 4637070

SUMMARY OF INVENTION

Technical Problem

However, according to a technology described in PTL 1, a write processing period and a compensation processing period (threshold compensation period) are respectively required for a horizontal scan period, and thus there is a problem in which, if a high definition of a display device advances, the write processing period and the compensation processing period cannot be sufficiently secured, and an amount of light of a light emission element cannot be controlled.

The present invention has been made to solve the above-described problems, and an object thereof is to provide a drive circuit of a display device which easily control an amount of light of the display device, the display device, and a driving method.

Solution to Problem

The present invention has been made to solve the above-described problems, and according to an aspect of the present invention, a drive circuit includes a retention unit retaining input data which is supplied; and a light emission control unit compensating a value of a drive current that flows to a light emission element based on the input data which is retained in the retention unit; and wherein the light emission control unit compensates the value of the drive current that flows to the light emission element after the retention unit retains the input data, wherein a write processing period in which the input data is retained in the retention unit overlaps a period in which the light emission control unit drives the light emission element.

In addition, according to an aspect of the drive circuit, the drive circuit further includes a compensation processing period, a plurality of light emission control units respectively compensating the value of the drive current during the compensation processing period, wherein the write processing period and the compensation processing period are separately provided, a plurality of retention units retaining the input data during the write processing period.

In addition, according to an aspect of the drive circuit, the plurality of light emission control units collectively perform processing of compensating a value of each drive current.

In addition, according to an aspect of the drive circuit, the plurality of light emission control units control such that the respective compensation processing periods coincide with each other.

In addition, according to an aspect of the drive circuit, the write processing period overlaps the driving period, the input data being retained in the plurality of retention units during the write processing period, the plurality of light emission control units driving the light emission element during the driving period.

In addition, according to an aspect of the drive circuit, the plurality of retention units are provided in association with different horizontal scan signal lines.

In addition, according to an aspect of the drive circuit, the retention unit includes a sampling switch outputting a voltage according to the input data which represents an amount of light of the light emission element at a predetermined timing which is determined; and a first capacitor retaining the voltage which is output from the sampling switch, wherein the light emission control unit compensates the value of the drive current based on the voltage which is retained in the first capacitor, as the retained input data.

In addition, according to an aspect of the present invention, a display device of an active scan type in which a plurality of pixels are arranged in a matrix, includes multiple pairs of the retention unit and the light emission control unit, wherein the input data is written to the retention unit by write processing, the input data representing a brightness of a pixel that is adjusted by the light emission control unit.

In addition, according to an aspect of the display device, the display device further includes a scan signal line transmitting a first control signal to the pixel, the first control signal controlling the retention unit by sequentially scanning a plurality of pixels during a vertical scan period in which the plurality of pixels are sequentially scanned; and a control line transmitting a second control signal to the pixel included in a range in which a compensation processing of compensating a value of the drive current is collectively performed in the light emission control unit for the plurality of pixels, for each set of a pair of two scan signal lines along an extending direction of the scan signal line, during a predetermined period which is determined within the vertical scan period, the second control signal being related to the compensation processing and a light emission control; wherein the second control signal control is supplied according to the set of the scan signal lines.

In addition, according to an aspect of the display device, the display device further includes a data signal line transmitting the input data to the pixel, the input data being written to the retention unit of the plurality of pixels during a vertical scan period in which the plurality of pixels are sequentially scanned; and a control line transmitting a second control signal to the pixel included in a range in which a compensation processing of compensating a value of the drive current is collectively performed in the light emission control unit for the plurality of pixels during a predetermined period which is determined within the vertical scan period, the second control signal being related to the compensation processing and a light emission control for each set of a pair of two data signal lines along an extending direction of the data signal line; wherein the second control signal control is supplied according to the set of the data signal lines.

In addition, according to an aspect of the display device, an area of a display unit in which the plurality of pixels are provided is divided into a plurality of areas, and wherein a second control signal is independently supplied to each of the divided areas, the second control signal being related to a compensation processing of generating the value of the drive current and a light emission control.

In addition, according to an aspect of the display device, a third control signal is supplied in a predetermined period which is determined within a vertical scan period in which the plurality of pixels are sequentially scanned, the third control signal providing a compensation processing period in which a compensation processing of generating a value of the drive current is collectively performed in the light emission control unit for the plurality of pixels, and wherein the light emission control unit includes a drive unit which drives the light emission element, and wherein the light emission control unit compensates the value of the drive current according to threshold characteristics of the drive unit during the compensation processing period, according to the third control signal which provides the compensation processing period.

In addition, according to an aspect of the display device, a fourth control signal is supplied during the vertical scan periods in which the plurality of pixels are sequentially scanned, the fourth control signal providing a write processing period in which the supplied input data is retained in the retention unit and the compensation processing period in which the values of the drive currents are respectively compensated in different periods, and wherein the retention unit retains the supplied input data during the write processing period, according to the fourth control signal which provides the write processing period and the compensation processing period in the different periods.

In addition, according to an aspect of the display device, a fifth control signal in which the write processing period is included in a light emission period in which the light emission element emits light is supplied, and wherein the light emission control unit makes the light emission element emit light during the light emission period, according to the fifth control signal in which the write processing period is included in the light emission period in which the light emission element emits light.

In addition, according to an aspect of the display device, the retention unit retains the input data during a light emission period in which the light emission element emits light based on the input data that forms an image of a first frame, the input data forming an image of a second frame following the first frame.

In addition, according to an aspect of the display device, the light emission control unit includes a field effect transistor which adjusts the drive current, and a second capacitor which is coupled to a gate terminal of the field effect transistor, and wherein the light emission control unit discharges an electric charge during the period from the write processing period to the compensation processing period, the electric charge being accumulated in the second capacitor which is coupled to the gate terminal of the field effect transistor.

In addition, according to an aspect of the display device, the display device further includes a timing signal generation unit generating the third control signal.

In addition, according to an aspect of the display device, the timing signal generation unit generates the fourth control signal.

In addition, according to an aspect of the display device, the timing signal generation unit generates a fifth control signal that controls such that the write processing period is included in a light emission period in which the light emission element emits light.

In addition, according to an aspect of the present invention, a driving method includes a step of a light emission control compensating a value of a drive current that flows to a light emission element based on the input data which is retained in the retention unit after the retention unit retains the input data, and wherein a write processing period in which the input data is retained in the retention unit overlaps a period in which the light emission control unit drives the light emission element.

Advantageous Effects of Invention

According to the present invention, it is possible to provide a drive circuit of a display device which easily controls an amount of light of a light emission element, a display device, and a driving method.

DESCRIPTION OF EMBODIMENTS

Hereinafter, embodiments of the present invention will be described with reference to the drawings.

First Embodiment

Figure 1:
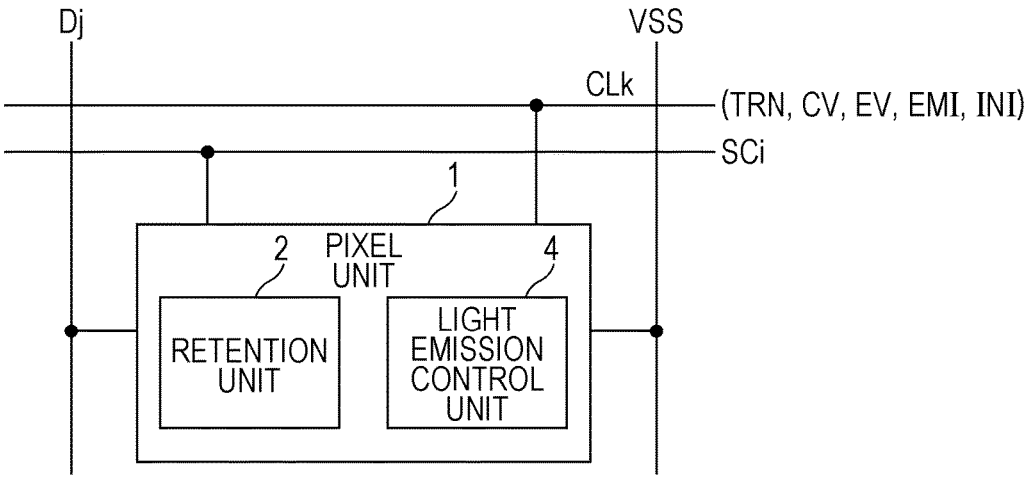
FIG. 1 is a schematic configuration diagram illustrating a pixel unit according to a first embodiment.

FIG. 1 is a diagram illustrating a basic configuration of a pixel unit of a display device according to an embodiment of the present invention.

In FIG. 1, a pixel unit 1 is configured to include a retention unit 2 and a light emission control unit 4. The pixel unit 1 adjusts an amount of emitted light of a light emission element which is provided in the light emission control unit 4, so as to emit light with brightness in accordance with written input data.

In a case in which the pixel unit 1 performs a color display, the pixel unit 1 includes a plurality of subpixels. In this case, multiple sets of the retention unit 2 and the light emission control unit 4 are provided in accordance with the number of the subpixels in the pixel unit 1.

A data signal line Dj to which input data is supplied, a scan line SCi (scan signal line) which represents a write timing (sampling timing), a set of control lines CLk to which various control signals (signal sTRN, signal sCV, signal sEV, signal sEMI, signal sINI) are supplied, and a power supply line (VSS or the like) which is a reference potential are coupled to the pixel unit 1. The respective signals will be described in detail later.

The retention unit 2 receives input data which represents an amount of emitted light of a light emission element via the data signal line Dj, and retains the above-described input data which is supplied in a capacitor (represented by C1 in FIG. 4), in accordance with a write timing (sampling timing) which is supplied via the scan line SCi.

The light emission control unit 4 includes a drive unit that makes a flow of a drive current by which a light emission element emits light. The drive unit includes an active semiconductor element which adjusts the drive current of the light emission element, and the light emission control unit 4 performs compensation processing of compensating a value of the drive current of the light emission element in accordance with threshold characteristics of the active semiconductor element. The light emission control unit 4 generates a value of the drive current of the light emission element which is compensated by the above-described compensation processing, based on input data which is retained in the retention unit 2, and controls the drive current in accordance with the generated value.

By doing this, the supplied input data is retained in the retention unit 2, and thereby the light emission control unit 4 compensates a value of the drive current which flows to the light emission element, based on the input data which is retained in the retention unit 2.

In addition, after the input data is retained in the retention unit, the light emission control unit 4 can also compensate the value of the drive current which flows to the light emission element.

Figure 2:
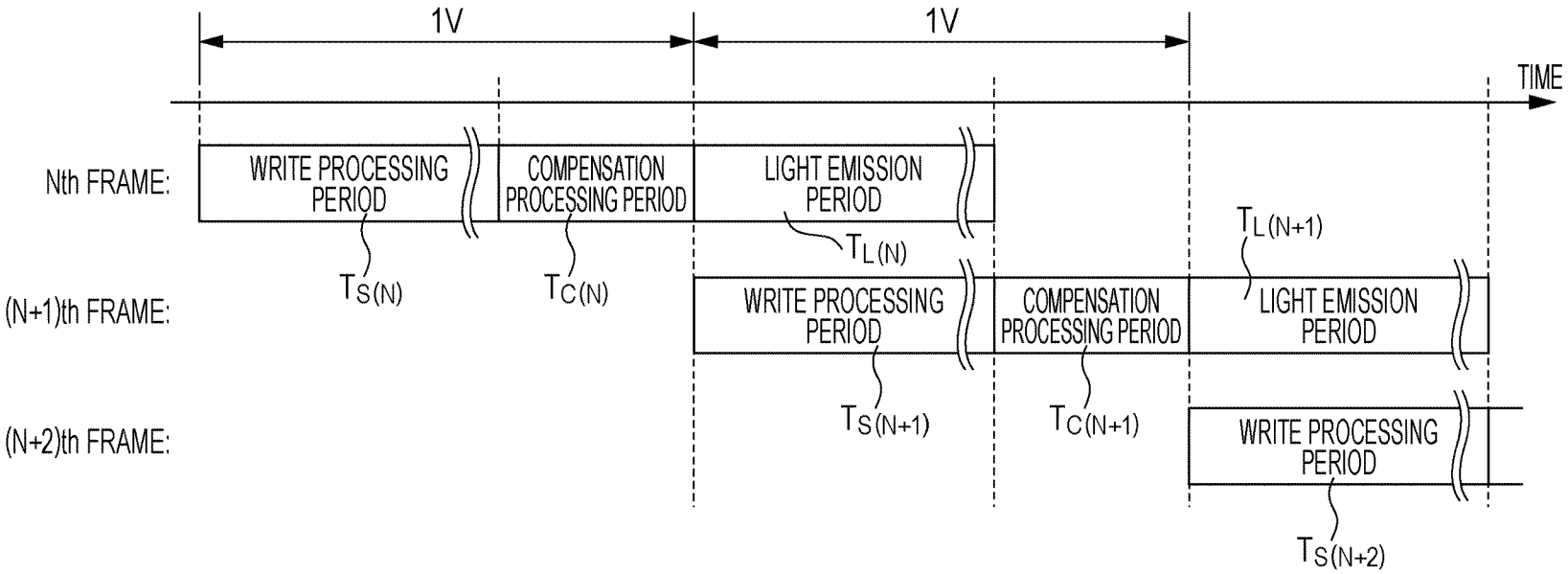
FIG. 2 is a timing diagram illustrating a display control of the pixel unit according to the present embodiment.

FIG. 2 is a timing diagram illustrating a display control of the pixel unit according to the present embodiment.

FIG. 2 illustrates a timing of a control of displaying a video signal with three frames from an Nth frame to an (N+2)th frame on a display unit.

Processing of each frame is performed by dividing each frame into three periods which are sequentially illustrated. The three periods are a write processing period, a compensation processing period, and a light emission period.

A write processing period $T_S$ is a period in which input data is retained in the retention unit 2. During the write processing period $T_S$, each retention unit 2 retains the input data which is synchronized during a vertical synchronization period and in which a frame is written as a unit. During the write processing period $T_S$, a plurality of input data is supplied in a time divisional manner, and input data which is a target from among the plurality of input data is written to the retention unit 2 corresponding to the input data.

The compensation processing period $T_C$ is a period in which the light emission control unit 4 respectively compensates the values of the drive currents of the light emission elements. For example, during the compensation processing period $T_C$, the light emission control unit 4 generates a value of the drive current of the light emission element, based on the input data which is retained in the retention unit 2, and compensates the value of the generated drive current.

The light emission period $T_L$ is a period in which the light emission elements respectively emit light, with brightness according to the value of the compensated drive current.

In this way, in the present embodiment, processing which is performed by a frame unit is assigned to any one of the write processing period $T_S$, the compensation processing period $T_C$, and the light emission period $T_L$ which do not overlap each other.

In addition, the processing (that is, processing to be performed without extending the frame) which is performed by the above-described frame unit is performed in a sequence of a write processing period, a compensation processing period, and a light emission period. For example, in a case of the Nth frame, the processing is performed in a sequence of a write processing period $T_S(N)$, a compensation processing period $T_C(N)$, and a light emission period $T_L(N)$. In the same manner, in a case of the (N+1)th frame, the processing is performed in a sequence of a write processing period $T_S(N+1)$, a compensation processing period $T_C(N+1)$, and a light emission period $T_L(N+1)$. In a case of the (N+2)th frame, the processing is performed in a sequence of a write processing period $T_S(N+2)$, a compensation processing period $T_C(N+2)$, and a light emission period $T_L(N+2)$.

Time which is assigned to a display of each frame corresponds to a length of a vertical scan period (1 V). As illustrated in FIG. 2, the write processing period $T_S(N)$ and the compensation processing period $T_C(N)$ are assigned to the vertical scan period (1 V) of the Nth frame, but the light emission period $T_L(N)$ is not fit to the vertical scan period (1 V) of the Nth frame. Thus, the light emission period $T_L(N)$ is assigned to the next (N+1)th frame. In short, the write processing period $T_S(N)$ and the light emission period $T_L(N)$ are respectively assigned to periods of two frames.

As described above, after the retention unit 2 retains the input data during the write processing period $T_S(N)$, the light emission control unit 4 compensates a value of the drive current which flows to the light emission element during the compensation processing period $T_C(N)$.

In other frames, for example, the Nth frame and the (N+1)th frame, the write processing period $T_S(N+1)$ in which the input data is retained in the retention unit 2 in the (N+1)th frame overlaps the light emission period $T_L(N)$ in which the light emission control unit 4 drives the light emission element in the Nth frame.

A relationship between a write processing period and a compensation processing period will be described based on a single pixel unit 1. In the same pixel unit 1, a timing in which the retention unit 2 performs write processing overlaps a timing in which the light emission control unit 4 performs light emission processing of the light emission element. More specifically, while the light emission control unit 4 drives the light emission element so as to display information (input data) of an image of the Nth frame during the light emission period $T_L(N)$, information (input data) of an image of the (N+1)th frame is written to the retention unit 2 corresponding to the light emission control unit 4, as processing of the write processing period $T_S(N+1)$ of the (N+1)th frame.

Next, in a case in which there is a plurality of pixel units 1, a relationship between the write processing period and the compensation processing period will be described. The timing illustrated in FIG. 2 is also applied to a case in which a plurality of pixel units 1 is provided in a display panel. In this case, writing processing of retaining the respective input data in a plurality of retention units 2 is performed during the writing processing period. In addition, a plurality of light emission control units 4 respectively drives the light emission elements during the light emission period. For this reason, even in a case in which a plurality of pixel units 1 is provided, the write processing period in which the input data is retained in the plurality of retention units 2 can be provided so as to overlap a period in which the plurality of light emission control units 4 drives the light emission elements, in the same manner as in a case in which the pixel unit 1 is described as a single pixel.

In this way, by overlapping the write processing period in which the input data is retained in the plurality of retention units 2 with the period in which the plurality of light emission control units 4 drives the light emission elements, each time can be secured, compared to a case in which the write processing period is provided so as to be separated from the period in which the plurality of light emission control units 4 drives the light emission elements.

In this case, the plurality of retention units 2 is provided so as to correspond to other horizontal scan lines (horizontal scan signal lines).

In this way, the plurality of retention units is provided so as to correspond to other horizontal scan lines, and thereby, even in a case in which the write processing period and the period in which the plurality of light emission control units drives the light emission elements overlap each other, each processing can be performed independently, and thus each time can be efficiently used, compared to a case of being provided so as to correspond to the same horizontal scan signal line.

Next, a relationship between a write processing period and a compensation processing period will be described based on processing during one frame. A write processing period which is included in a predetermined range according to a frame and in which input data is retained in the plurality of retention units 2 can be provided so as to be separated from a compensation processing period in which the plurality of light emission control units 4 respectively compensates values of drive currents of the light emission elements.

In this way, the write processing period in which the input data is retained in the plurality of retention units can be provided so as to be separated from the compensation processing period in which the plurality of light emission control units respectively compensates the values of the drive currents of the light emission elements.

As threshold compensation processing in the same frame, the plurality of light emission control units 4 may collectively compensate the respective values of the drive currents.

In this way, the plurality of light emission control units collectively performs the processing of compensating the respective values of the drive currents, and thereby it is possible to complete the processing in a shorter time than independently performing processing.

In addition, the plurality of light emission control units may perform the respective compensation processing periods so as to coincide with each other.

In this way, the plurality of light emission control units performs the respective compensation processing periods so as to coincide with each other, and thereby it is possible to complete the processing in a shorter time than independently performing processing.

In the embodiment described above, a drive circuit 6 of the pixel unit 1 can secure a write processing period and a compensation processing period, and can easily control an amount of light of a light emission element.

Figure 3:
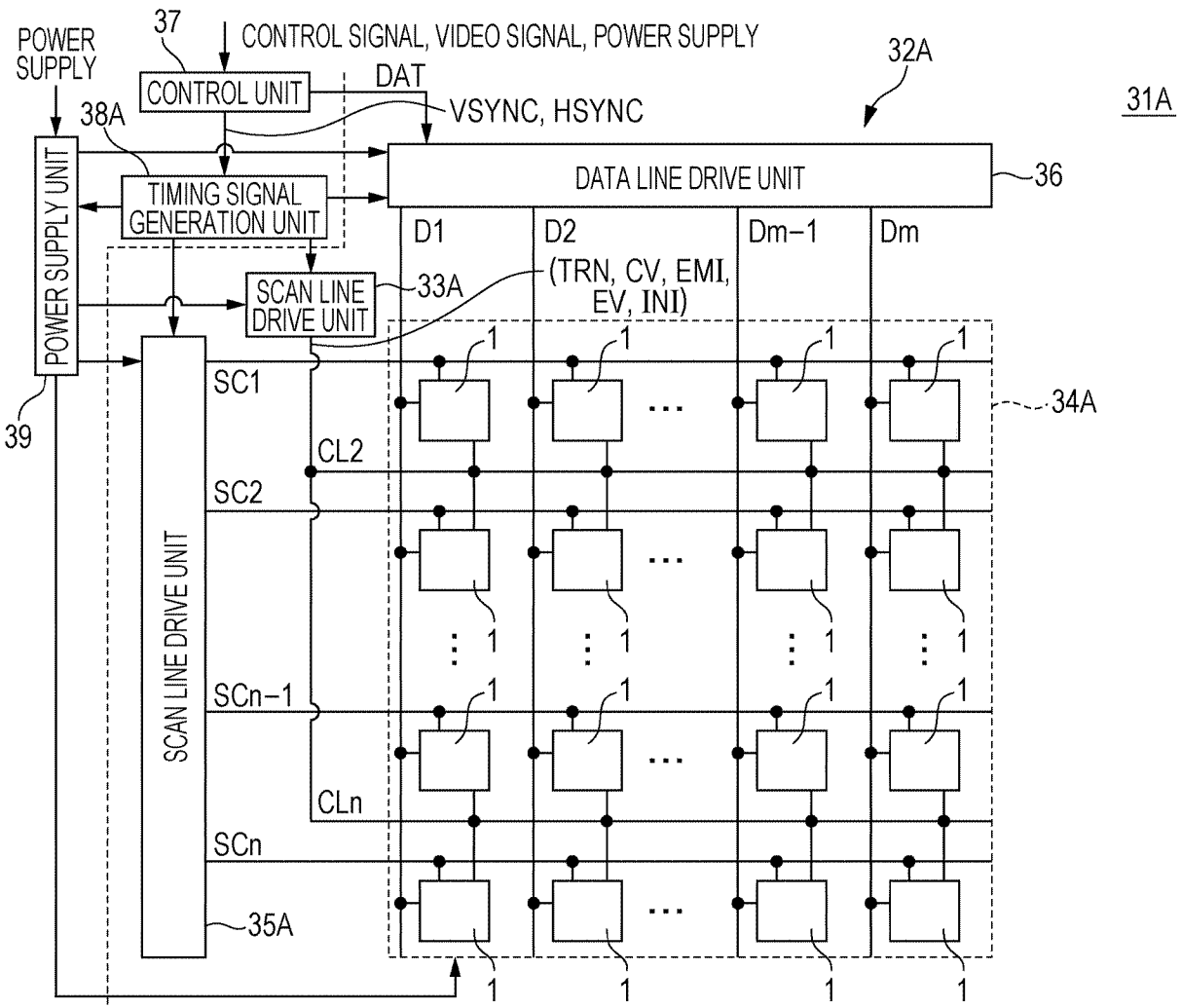
FIG. 3 is a block diagram of a display device according to the present embodiment.

FIG. 3 is a block diagram illustrating a configuration of a display device 31A according to the present embodiment. The display device 31A includes a display panel 32A, a control unit 37, a timing signal generation unit 38A, and a power supply unit 39.

The display panel 32A is configured to include a display unit 34A which includes a plurality of pixel units 1 that is arranged in a matrix of n rows×m columns, scan line drive units 33A and 35A which drive the respective pixel units 1, and a data line drive unit 36. The display panel 32A is driven by a driving method of an active scan type.

The scan line drive unit 33A supplies a set of control lines CL2 to CLn with control signals. The scan line drive unit 35A supplies scan lines SC1 to SCn with control signals.

In order to reduce processes and wire capacitances at the time of manufacturing, the display unit 34A, the scan line drive units 33A and 35A, and the data line drive unit 36 are monolithically formed on the same substrate. In addition, in order to integrate many pixel units 1 and to enlarge a display area, the display unit 34A, the scan line drive units 33A and 35A, and the data line drive unit 36 are configured by a polysilicon thin film transistor or the like which is formed on a glass substrate. The processes at the time of manufacturing described above are an example.

The display unit 34A is partitioned by n scan lines SC1 to SCn which intersect each other in a horizontal direction, and m data signal lines D1 to Dm in a vertical direction, and a plurality of pixel units 1 is provided at a position of intersection of each signal line.

A set of control lines CL2 to CLn is provided in an extending direction of the scan lines SC1 to SCn. One control line is provided for each of two scan lines, and thereby the total number of the set of control lines CL2 to CLn is half the total number of the scan lines SC1 to SCn. For example, a control line TRN, a control line CV, a control line EMI, a control line EV, and a control line INI are included in the set of control lines CL2 to CLn.

The scan lines SC1 to SCn transfer a signal sSCi (control signal) which controls the retention unit 2 to the pixel unit 1, during a vertical scan period in which the plurality of pixel units 1 is sequentially scanned. During a predetermined period which is determined within the vertical scan period, a range in which compensation processing of compensating values of drive currents is collectively performed on a plurality of pixels is determined. The set of control lines CL2 to CLn supplies the same control signal for the pixel units 1 of the range in which the compensation processing is collectively performed.

A control signal for compensating processing and a light emission control is supplied by the set of control lines CL2 to CLn, according to the set of scan lines.

An area in which one control line, for example, the set of control line CL2 is provided is positioned between two pixel units 1 to which the scan lines SC1 and SC2 are respectively coupled. In this way, a wiring area is provided between a set of two pixel units 1 corresponding to each other, and thereby wiring from the set of control line CL2 to the pixel unit 1 which is coupled to the scan line SC1, and wiring from the set of control line CL2 to the pixel unit 1 which is coupled to the scan line SC2 can be efficiently performed, and it is possible to reduce a wiring area. It is assumed that wiring areas are provided from the control line CL4 to the control line CLn in the same manner.

In this way, a control line which transfers a control line for compensation processing and a light emission control is provided in each of two scan lines, and thereby it is possible to reduce a wiring area.

Figure 4:
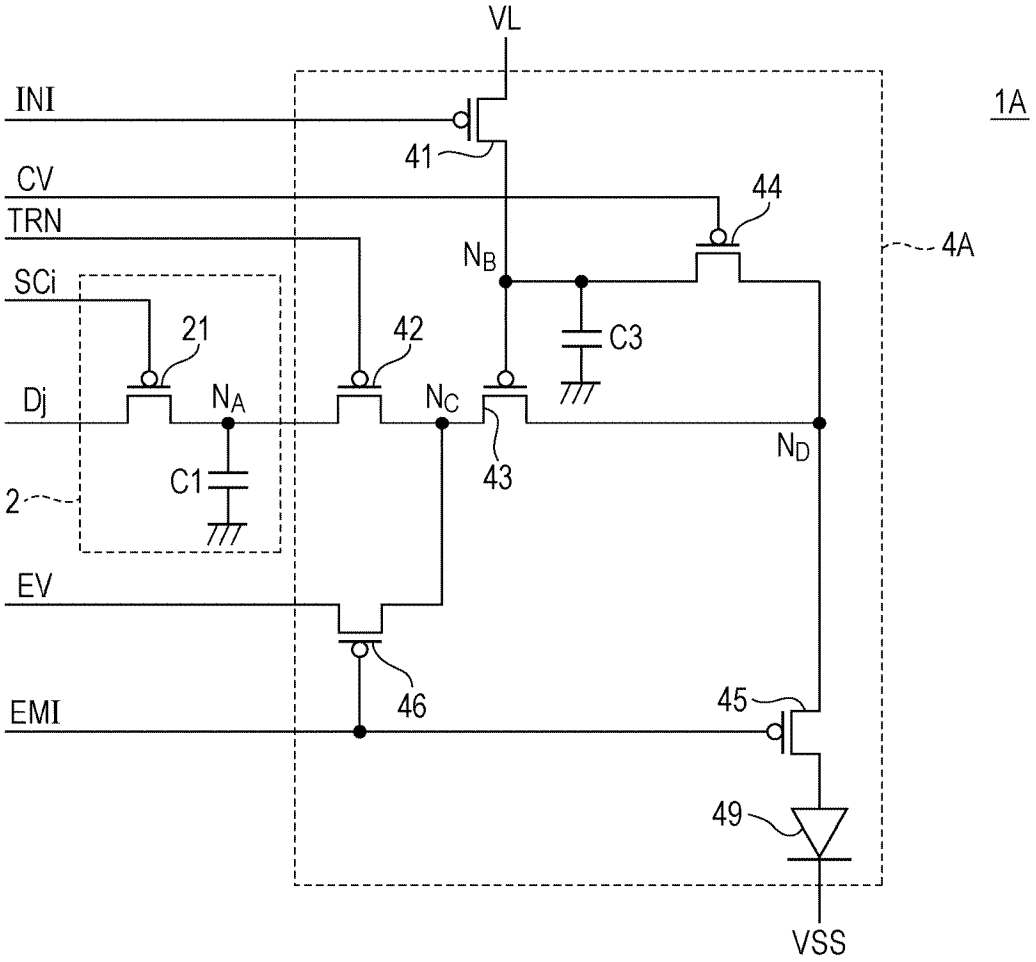
FIG. 4 is a circuit diagram illustrating the pixel unit according to the present embodiment.

FIG. 4 is a circuit diagram illustrating a configuration of the pixel unit 1 according to the present embodiment. Each active element illustrated in FIG. 4 is a field effect transistor, particularly a PMOS type, but an NMOS type may be used. Hereinafter, a field effect transistor is referred to as a "transistor", with regard to the present embodiment.

A pixel unit 1A (1) is configured to include the retention unit 2 and a light emission control unit 4A. In a case in which the pixel unit 1 is configured to include a plurality of subpixels according to three original colors, multiple retention units 2 and multiple light emission control units 4A are provided in accordance with the number of subpixels.

The retention unit 2 is configured to include a transistor 21, and a capacitor C1 (there is a case of being referred to as "first capacitor").

A gate of the transistor 21 is coupled to the scan line SCi, and a source of the transistor is coupled to the data line Dj.

One electrode of the capacitor C1 is coupled to a drain of the transistor 21, the other electrode of the capacitor C1 is coupled to a common electrode line. In FIG. 4, the common electrode line is illustrated as the ground. A connection point of the drain of the transistor 21 and the capacitor C1 is referred to as a node $N_A$.

The capacitor C1 may be configured by coupling in parallel a plurality of capacitors, and may include a stray capacitor in a wiring area.

Thus, if the scan line SCi is selected, the transistor 21 in the retention unit 2 is turned on, and a voltage which is applied to the data line Dj is applied to the capacitor C1. Meanwhile, while a selection period of the scan line SCi is ended and the field effect transistor 21 is turned off, the capacitor C1 continuously retains a voltage of the capacitor C1 at the time of being turned off. Thus, by selecting the scan line SCi and applying a video signal DAT to the data signal line Dj, it is possible to retain a voltage which controls an amount of light of the pixel unit 1 in the node $N_A$.

The transistor 21 functions as a sampling switch which outputs a voltage according to input data that represents an amount of light of a pixel at a predetermined timing which is determined. The transistor 21 is exemplified as a sampling switch, but a switch of other forms may be used.

In this way, the retention unit 2 has a simple configuration, thereby having an effect of being able to compensate a value of a drive current, based on a voltage which is retained in the capacitor C1 as input data that is retained.

Next, the light emission control unit 4A will be described.

The light emission control unit 4A is configured to include transistors 41, 42, 43, 44, 45, and 46, a capacitor C3 (there is a case of being referred to as a "second capacitor"), and a light emission element 49.

A gate of the transistor 41 is coupled to a control line INI, and a source of the transistor 41 is coupled to a control line VL.

A gate of the transistor 42 is coupled to a control line TRN, and a source of the transistor 42 is coupled to the node $N_A$ of the retention unit 2.

A gate of the transistor 43 is coupled to the drain of the transistor 41, and a source of the transistor 43 is coupled to the drain of the transistor 42. A connection point of the drain of the transistor 42 and the source of the transistor 43 is referred to as a node $N_C$, and a connection point of the gate of the transistor 43 and the drain of the transistor 41 is referred to as a node $N_B$.

One electrode of the capacitor C3 is coupled to the node $N_B$, and the other electrode of the capacitor C3 is coupled to a common electrode line.

A gate of the transistor 44 is coupled to a control line CV, a source of the transistor 44 is coupled to the node $N_B$, and a drain of the transistor 44 is coupled to a drain of the transistor 43. A connection point of the drain of the transistor 43 and the drain of the transistor 44 is referred to as a node $N_D$.

A gate of the transistor 46 is coupled to a control line EMI, a source of the transistor 46 is coupled to a control line EV, and a drain of the transistor 46 is coupled to the node $N_C$.

A gate of the transistor 45 is coupled to a control line EMI, a drain of the transistor 45 is coupled to the node $N_D$, and a source of the transistor 45 is coupled to an anode of the light emission element 49.

A cathode of the light emission element 49 is coupled to a power supply line VSS.

By applying a voltage of the control line CV to the gate of the transistor 44, the transistor 44 enters a turn-off state, and then a voltage of the control line INI is applied to the gate of the transistor 41, and thereby if the transistor 41 is turned on, a voltage of the control line VL is applied to the capacitor C3, and a potential of the capacitor C3 is initialized.

Herein, description will be continued by returning to FIG. 3.

The control unit 37 generates the video signal DAT, a signal VSYNC which is a synchronization signal of the vertical scan period, a signal HSYNC which is a synchronization signal of the horizontal scan period, and the like, based on a control signal and a video signal which are supplied from the outside. The control unit 37 performs a time division of the video signal DAT which is transferred to each pixel unit 1, and supplies the data line drive unit 36 with the time-divided signal.

The control unit 37 supplies the timing signal generation unit 38A with the signals VSYNC and HSYNC.

The timing signal generation unit 38A generates various timing signals which operate the display unit 34A, the scan line drive units 33A and 35A, the data line drive unit 36, and the power supply unit 39.

The timing signal generation unit 38A supplies the scan line drive unit 33A with the generated timing signal. The timing signal which operates the scan line drive unit 33A is synchronized with the signal VSYNC.

The timing signal generation unit 38A generates timing signals which operate the scan line drive unit 35A and the data line drive unit 36, and supplies the scan line drive unit 35A and the data line drive unit 36 with the generated timing signals. The timing signals which operate the scan line drive unit 35A and the data line drive unit 36 are synchronized with the signal VSYNC and the signal HSYNC.

The timing signal generation unit 38A supplies the power supply unit 39 with the timing signal. The timing signal which operates the power supply unit 39 is synchronized with the signal VSYNC and the signal HSYNC.

The timing signal generation unit 38A generates a control signal which provides a compensation processing period in which compensation processing is collectively performed for a plurality of pixels in a predetermined period which is determined within a vertical scan period in which the plurality of pixel units 1 is sequentially scanned to. The compensation processing is processing in which the light emission control unit 4A compensates a value of a drive current of the light emission element 49.

By doing this, various timing signals which drive a display device (display panel) are generated, and furthermore, a predetermined period which is determined within the vertical scan period is determined as a compensation processing period, and compensation processing of a plurality of pixels can be collectively performed.

The timing signal generation unit 38A generates a control signal that provides a write processing period in which the retention unit 2 retains a drive current, and the compensation processing period, in other periods, during a vertical scan period.

In this way, by providing the write processing period and the compensation processing period, in other periods, each processing can be performed together during each period, and thereby time can be efficiently used.

The timing signal generation unit 38A generates a control signal which controls a write processing period so as to be included in a light emission period in which the light emission element 49 emits light.

In this way, by including the write processing period in the light emission period, the light emission period and the write processing period are not required to coincide with each other, and can be independently controlled within a range of the light emission period. By doing this, it is possible to lengthen the light emission period more than the write processing period without being bound to the timing of the write processing period.

The data line drive unit 36 extracts video data which is supplied from the video signal DAT to the respective pixel units 1, in synchronization with a timing signal which is supplied from the timing signal generation unit 38A.

Specifically, the data line drive unit 36 extracts the video signal DAT in synchronization with the timing signal which is supplied from the timing signal generation unit 38A, and outputs the video signal to the respective data signal lines D1 to Dm. For example, signals which are output to the respective data signal lines D1 to Dm are analog signals according to the video signal DAT. In this case, the data line drive unit 36 generates a voltage according to the video signal DAT, based on the video signal DAT.

In the same manner, the scan line drive unit 33A outputs scan signals which have timings different from each other by a predetermined interval to the respective scan lines SC1 to SCn, in synchronization with a timing signal which is supplied from the timing signal generation unit 38A.

In addition, the control unit 37 and the power supply unit 39 receive power from the outside. The power supply unit 39 supplies each unit in a display device with the power, and determines a reference potential which operates the respective units.

Figure 5:
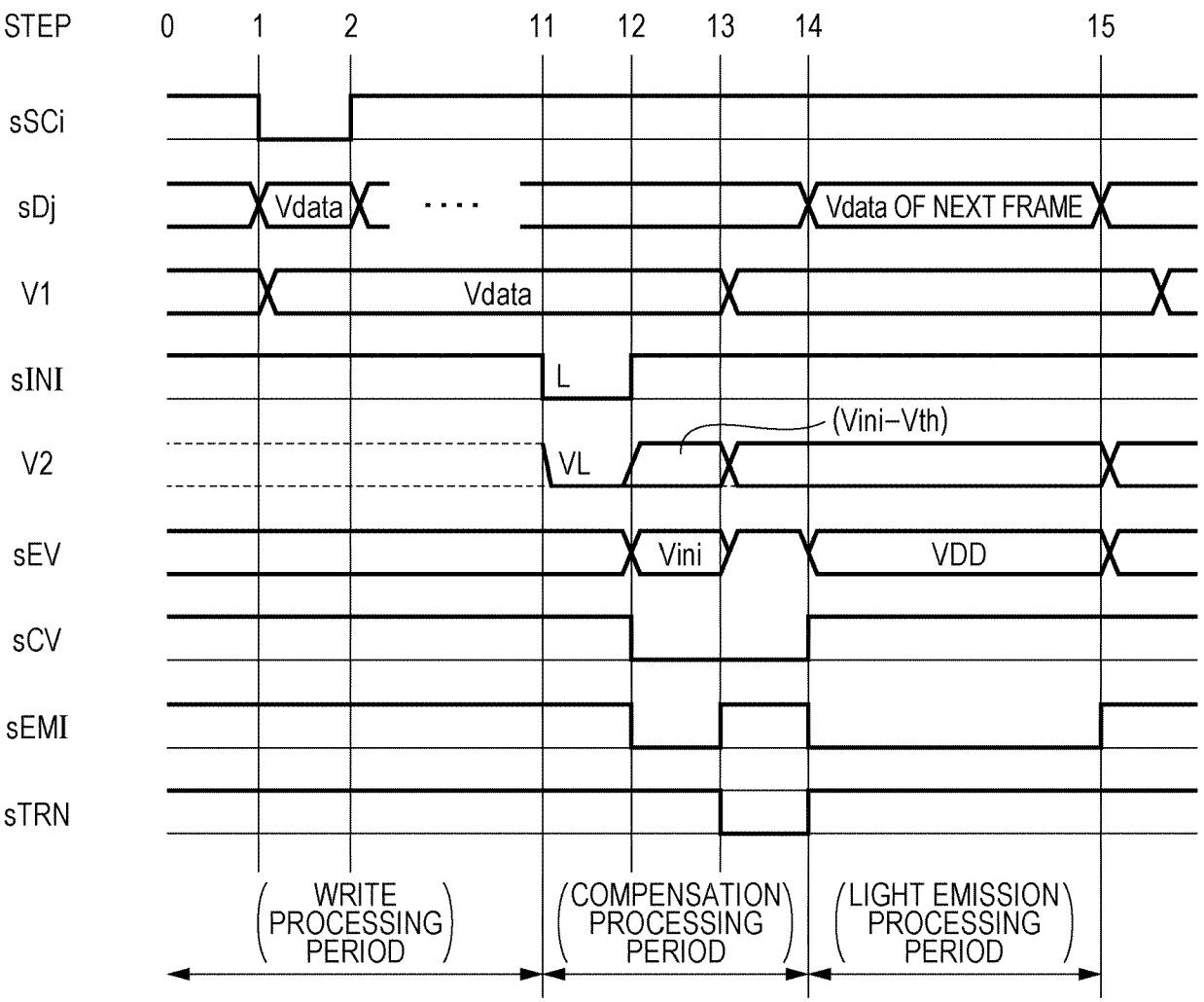
FIG. 5 is a timing diagram illustrating a drive of the pixel unit according to the present embodiment.

FIG. 5 is a timing diagram illustrating a drive of the display unit 34A. Processing with regard to a drive of the display unit 34A includes processing which is performed in a write processing period, a threshold compensation processing period, and a light emission period.

In FIG. 5, the respective signals of a signal sSCi, input data sDj, a potential (V1) of the node $N_A$, a signal sINI, a potential (V2) of the node $N_B$, a signal sEV, a signal sCV, a signal sEMI, and a signal sTRN, are sequentially illustrated side by side from the top, in addition to step numbers which represent steps of processing. Among the above-described signals, the input data sDj, the potential (V1) of the node $N_A$, the potential (V2) of the node $N_B$, and the signal sEV represent analog values which represent the respective potentials. The signal sSCi, the signal sINI, the signal sCV, the signal sEMI, and the signal sTRN take a logical state of being binarized as an H (high) level and an L (low) level. The timing in which states of various signals illustrated in FIG. 5 are changed is generated by the above-described timing signal generation unit 38A.

Hereinafter, processing of each step will be sequentially described.

(step 0) Initial states of the respective signals are determined as follows. Signal levels of all the control signals, that is, the signal sSCi, the signal sINI, the signal sCV, the signal sEMI, and the signal sTRN are set to an H level. Thus, the transistors 21, 41, 42, and 44 to 46 enter a turn-off state.

The transistor 43 takes a state of any one of turn-on and turn-off depending on a potential of the potential (V2) of the node $N_B$ of a previous frame.

(step 1) The signal sSCi is transitioned to an L level, and then a voltage Vdata according to a value of write input data is supplied to the input data Dj. The signal sSCi is applied to the gate of the transistor 21, and thereby the transistor 21 enters a turn-on state, and the potential (V1) of the node $N_A$ becomes Vdata. Thus, the capacitor C1 is charged to a voltage of Vdata.

(step 2) The signal sSCi is returned to an H level, and the transistor 21 is transitioned to a turn-off state. A potential of the node $N_A$ is retained as Vdata based on a voltage of the capacitor C1.

(step 11) The voltage VL is supplied to the source of the transistor 41, and the signal sINI is transitioned to an L level. By doing this, the transistor 41, to the gate of which the signal sINI is applied, enters a turn-on state, a potential of the node $N_B$ becomes VL. The capacitor C3, one electrode of which is coupled to the node $N_B$, enters a state of being charged to the voltage VL. The node $N_C$ and the node $N_D$ are floated, but the node $N_C$ takes, since the potential (V2) of the node $N_B$ is VL, the node $N_C$ takes a higher potential than VL, and thereby the transistor 43 is normally in a turn-on state.

(step 12) The signal sINI is returned to an H level, and the transistor 41, to the gate of which the signal sINI is applied, is transitioned to a turn-off state. By doing this, a potential of the node $N_B$ to which one electrode of the capacitor C3 is coupled is retained as VL, and thereby the transistor 43 enters a turn-on state.

In addition, the signal sEV becomes a voltage Vini, the signal sCV is transitioned to an L level, and the signal sEMI is transitioned from an H level to an L level. The transistor 46, to the gate of which the signal sEMI is applied, enters a turn-on state, and the node $N_C$ has the potential Vini. In addition, the transistor 44, to the gate of which the signal sCV is applied, enters a turn-on state, and the capacitor C3 discharges until the potential of the node $N_B$ having the same potential as the potential of the gate of the transistor 43 becomes a potential (Vini−Vth) which is compensated in accordance with threshold characteristics of the transistor 43 with respect to Vini. However, Vth is a threshold of the transistor 43. In addition, it is assumed that the potential Vini and the potential (VL+Vth) satisfy a condition which is represented by the following equation (1).

$$Vini > VL + Vth \tag{1}$$

(step 13) As the signal sCV is maintained at an L level, the signal sEMI is returned to an H level, and the signal sTRN is transitioned to an L level. By doing this, the transistor 46 enters a turn-off state, and the transistor 42 enters a turn-on state. Thus, a potential of the node $N_B$ is charged based on the potential of the node $N_A$ and the potential of the node $N_B$. In short, a potential according to an input of the data which is retained in the retention unit 2 is transferred to the light emission control unit 4, and compensation processing according to the threshold characteristics of the transistor 43 is performed in generating a value of a drive current.

(step 14) The signal sCV is returned to an H level, the signal sTRN is returned to an H level, and the transistor 44 and the transistor 42 enter a turn-off state.

Furthermore, the potential VDD is supplied to the signal sEV, and the signal sEMI is transitioned again to an L level. By doing this, the transistor 46 and the transistor 45 enter a turn-on state, a desired drive current flows into the light emission element 49, and it is possible for the light emission element 49 to emit light with a desired brightness.

The above-described (step 1) is included in the write processing period, (step 11) to (step 13) are included in the compensation processing period, and (step 14) corresponds to the light emission period. In addition, in a range of the above-described (step 0) or (step 2), the write processing with respect to the pixel unit 1 according to another horizontal scan line different from a horizontal scan line which performs processing of (step 1) is performed.

Next, a threshold compensation operation according to the present embodiment will be described in detail.

The potential V1 of the node VA according to the input data (Vdata) is represented by equation (2)

$$V1 = V\text{data} \tag{2}$$

A potential of the node $N_B$ is represented as a potential V2 in an equation (3). A potential of the equation (3) corresponds to a state of the above-described (step 11).

$$V2 = VL \tag{3}$$

A change of the potential V2 of the node $N_B$ is represented by an equation (4). The potential in the equation (4) corresponds to a state of the above-described (step 12).

$$V2 = Vini - Vth \tag{4}$$

However, Vth is a threshold of the transistor 43. It is assumed that, in the above-described equation (4), information of a threshold of the transistor 43 satisfies a condition of an equation (5) as a condition for being written as information which is retained in the capacitor C3, via the transistor 42 and the transistor 43.

$$Vini - Vth < V\text{data} - Vth \tag{5}$$

$$Q1 = C1 \lambda V\text{data} \tag{6}$$

$$Q2 = C2 \times (Vini - Vth) \tag{7}$$

In the above-described equation (5), when an initial value of the potential V2 of the node $N_B$ of the equation (4) is determined, the potential V2 is set so as to be lowered more than a potential which is lower than the input data Vdata by Vth.

In addition, Q1 is an electric charge which is accumulated in the capacitor C1, and Q2 is an electric charge which is accumulated in the capacitor C3.

A change of the potential V2 of the node $N_B$ is represented by an equation (8). A potential in the equation (8) corresponds to a state of the above-described (step 14).

$$V2 = V1 - Vth \tag{8}$$

The above-described equation (8) has a relationship illustrated in an equation (9) and an equation (10).

$$Q1 = C1 \times V1 = C1 \times (V2 + Vth) \tag{9}$$

$$Q2 = C2 \times V2 \tag{10}$$

From the equation (6) and the equation (7), and the equation (9) and the equation (10), a quantity of electric charges of the capacitor C1 and the capacitor C3 which are coupled in parallel with each other is maintained constant, and thereby a relationship of an equation (11) is derived.

$$Q1 + Q2 = C1 \times (V2 + Vth) + C2 \times V2 = C1 \times V\text{data} + C2 \times (Vini - Vth) \tag{11}$$

If the above-described equation (11) is organized with regard to V2, a relationship of an equation (12) is derived.

$$V2 = C1/(C1 + C2) \times V\text{data} + C2/(C1 + C2) \times Vini - Vth \tag{12}$$

Next, a drive current *IL* of the light emission element 49 is represented by an equation (13).

$$IL = \tfrac{1}{2}\beta(VDD - V2 - Vth)^2 \tag{13}$$

In the above-described equation (13), β represents a coefficient, Vth is a threshold of the transistor 43.

If the above-described equation (12) is applied to the above-described equation (13), the drive current IL can be represented by an equation (14).

$$IL = \tfrac{1}{2}\beta(VDD - C1/(C1 + C2) \times V\text{data} - C2/(C1 + C2) \times Vini)^2 \tag{14}$$

As represented by the above-described equation (14), the drive current IL has no term depending on the threshold Vth, and thus the drive current can be derived without being affected by the threshold.

The write processing period and the compensation processing period are divided, the threshold compensations are collectively performed in a certain display area, and thereby threshold compensation time can be reduced. In addition, it is preferable that a display area at which threshold compensation is collectively performed is the number of scan lines in which the total number of scan lines (an amount of 1 V) is divided by an integer. For example, data of an amount of 1 V is latched in a pixel electrode, and thereafter, threshold compensations are collectively performed. For the threshold compensation, the electric charges which are accumulated in a data latch unit are transferred to a threshold compensation unit, and a voltage which is obtained by performing the threshold compensation of the transistor 43 is generated.

In the present embodiment described above, the display device 31A secures a write processing period and a compensation processing period, thereby being able to easily control an amount of light of a light emission element.

Second Embodiment

Figure 6:
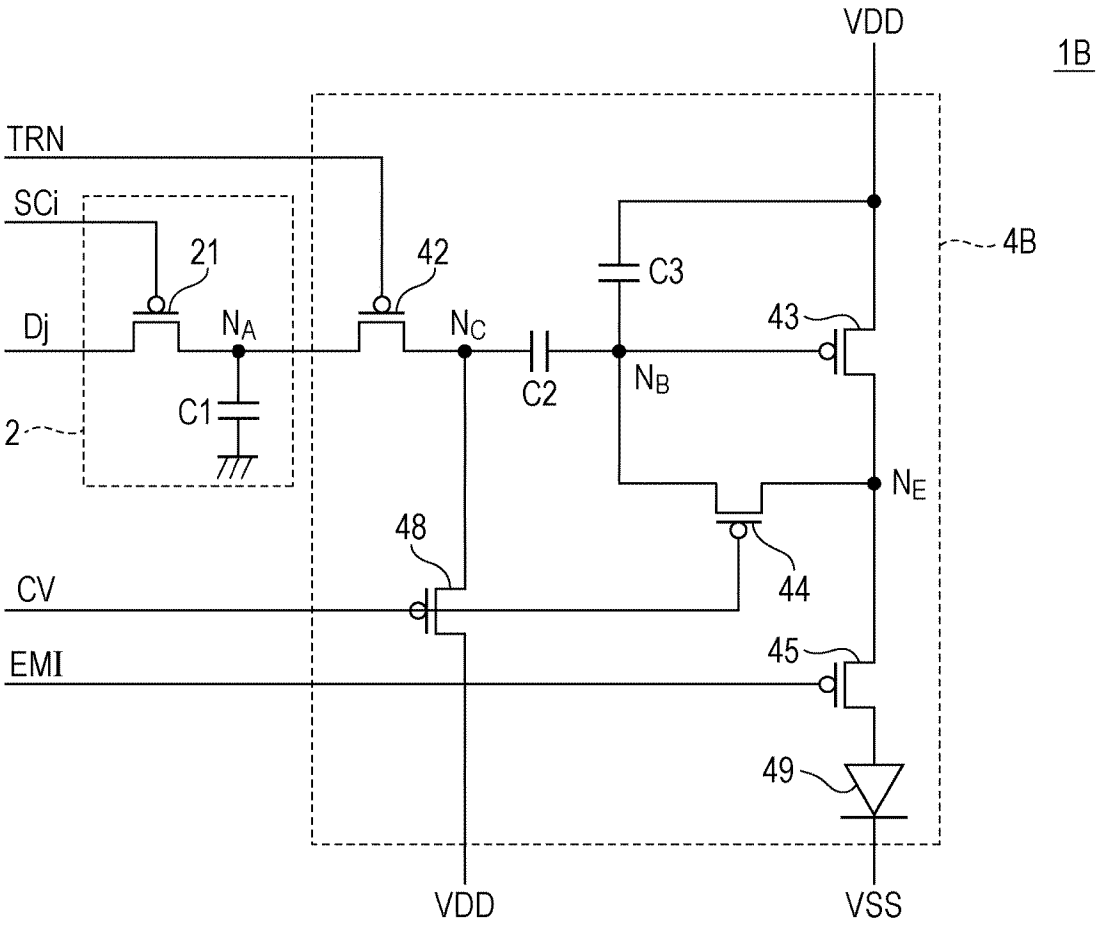
FIG. 6 is a circuit diagram illustrating a configuration of a pixel unit according to a second embodiment.

FIG. 6 is a circuit diagram illustrating a configuration of the pixel unit 1 according to the present embodiment.

A pixel unit 1B (1) illustrated in FIG. 6 is configured to include the retention unit 2 and a light emission control unit 4B. The pixel unit 1B illustrated in FIG. 6 is different from the pixel unit 1A illustrated in FIG. 4 in that the pixel unit 1B includes the light emission control unit 4B instead of the light emission control unit 4A of FIG. 4. In addition, the signal sINI and the signal sEV are removed from the control signals which are output from the timing signal generation unit 38A.

Next, the light emission control unit 4B will be described.

The light emission control unit 4B includes transistors 42, 43, 44, 45, and 48, capacitors C2 and C3, and a light emission element 49.

A gate of the transistor 42 is coupled to a control line TRN, and a source of the transistor 42 is coupled to a node $N_A$ of a retention unit 2.

A gate of the transistor 48 is coupled to a control line CV, a source of the transistor 48 is coupled to a power supply VDD, and a drain of the transistor 48 is coupled to the drain of the transistor 42. A connection point of the drain of the transistor 42 and the drain of the transistor 48 is referred to as a node $N_C$.

One electrode of the capacitor C2 is coupled to the node $N_C$.

A gate of the transistor 44 is coupled to the control line CV, and a source of the transistor 44 is coupled to the other electrode of the capacitor C2. A connection point of the source of the transistor 44 and the other electrode of the capacitor C2 is referred to as a node $N_B$.

One electrode of the capacitor C3 is coupled to the node $N_B$, and the other electrode of the capacitor C3 is coupled to the power supply line VDD.

A gate of the transistor 43 is coupled to the node $N_B$, a source of the transistor 43 is coupled to the power supply line VDD, and a drain of the transistor 43 is coupled to the drain of the transistor 44. A connection point of the drain of the transistor 43 and the drain of the transistor 44 is referred to as a node $N_E$.

A gate of the transistor 45 is coupled to a control line EMI, a drain of the transistor 45 is coupled to the node $N_E$, and a source of the transistor 45 is coupled to an anode of the light emission element 49.

A cathode of the light emission element 49 is coupled to a power supply line VSS.

Figure 7:
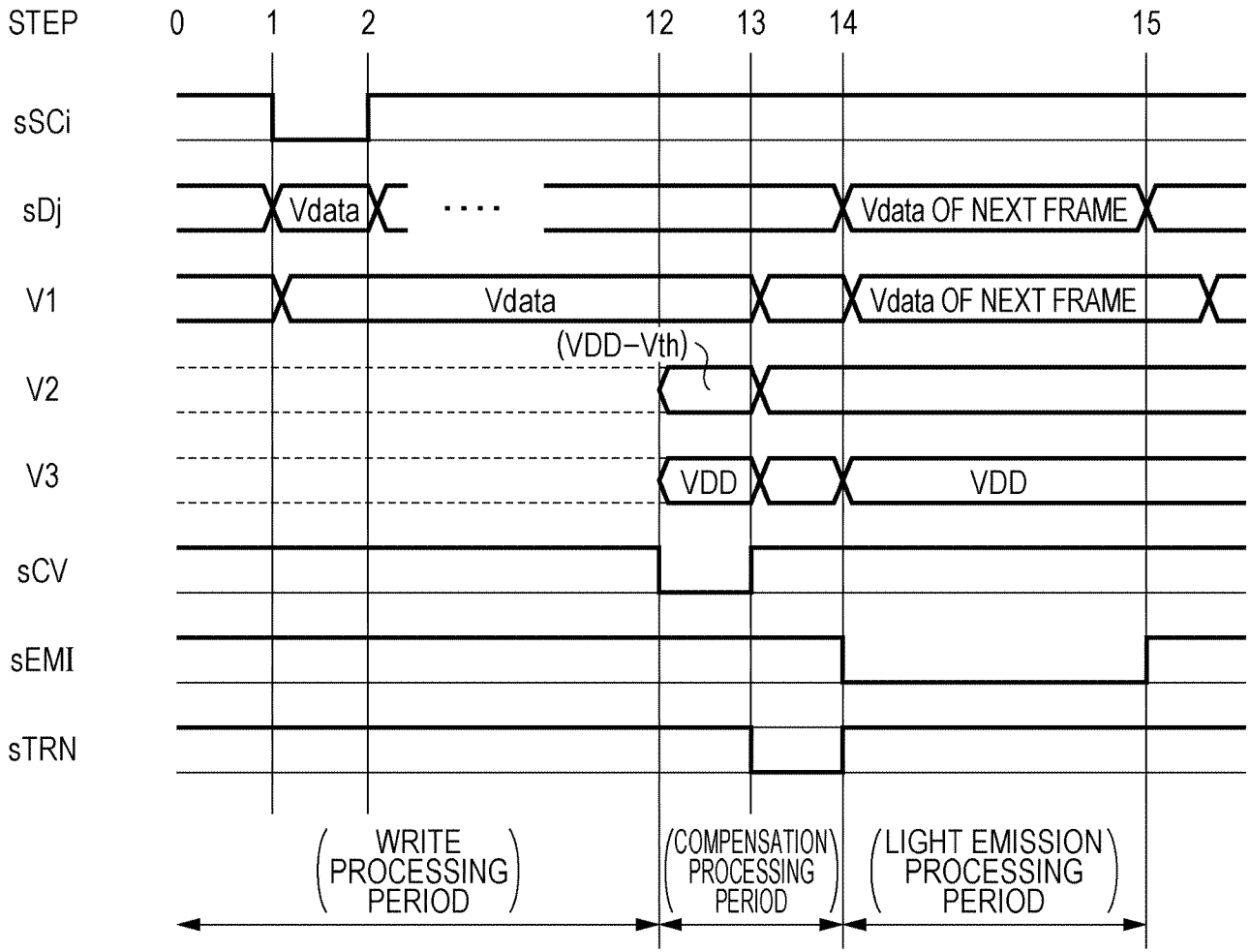
FIG. 7 is a timing diagram illustrating a drive of the pixel unit according to the present embodiment.

FIG. 7 is a timing diagram illustrating a drive of a display unit according to the present embodiment.

The timing diagram illustrated in FIG. 7 sequentially illustrates processing corresponding to the write processing period, the threshold compensation processing period, and the light emission period which are described above, in accordance with a time-series.

In FIG. 7, step numbers which represent steps of processing are illustrated on the top. In FIG. 7, the respective signals of a signal sSCi, input data sDj, a potential (V1) of the node $N_A$, a potential (V2) of the node $N_B$, a potential (V3) of the node $N_C$, a signal sCV, a signal sEMI, and a signal sTRN, are sequentially illustrated side by side from the top. Among the above-described signals, the input data sDj, the potential (V1) of the node $N_A$, the potential (V2) of the node $N_B$, and the potential (V3) of the node $N_C$ represent analog values which represent the respective potentials. The signal sSCi, the signal sCV, the signal sEMI, and the signal sTRN represent a logical state of being binarized.

(step 0) Initial states of the respective signals are determined as follows. Signal levels of all the control signals (the signal sSCi, the signal sCV, the signal sEMI, the signal sTRN) are set to an H (high) level.

(step 1) The signal sSCi is transitioned to an L (low) level, and a potential Vdata according to a value of write input data is supplied to the input data sDj. By doing this, the transistor 21 enters a turn-on state, and the potential (V1) of the node $N_A$ becomes the potential Vdata.

(step 2) The signal sSCi is returned to an H level, and the transistor 21 is transitioned to a turn-off state. By doing this, the potential (V1) of the node $N_A$ is retained as the potential Vdata.

(step 12) The signal sCV is transitioned to an L level. By doing this, the transistor 48 enters a turn-on state, and the potential (V3) of the node $N_C$ is charged to the potential VDD. In addition, the transistor 44 enters a turn-on state, and the potential (V2) of the node $N_B$ becomes a potential (VDD−Tth (threshold of the transistor 43)).

(step 13) The signal sCV is returned to an H level, and the signal sTRN is transitioned to an L level.

By doing this, the transistors 44 and 48 enter a turn-off state, the transistor 42 enters a turn-on state, and thus the potential (V2) of the node $N_B$ is charged based on the potential (V1) of the node $N_A$ and the potential (V3) of the node $N_C$. A voltage according to an input of the data which is retained in the retention unit 2 is transferred to the light emission control unit 4B, and compensation processing according to the threshold characteristics of the transistor 43 is performed while generating a value of a drive current. A drive current is determined based on the potential (V2) of the node $N_B$.

(step 14) The signal sTRN is returned to an H level, and the transistor 42 enters a turn-off state.

In addition, the signal sEMI is transitioned to an L level. By doing this, TR48 enters a turn-on state, a desired drive current flows into the light emission element 49, and thereby it is possible for the light emission element 49 to emit light with a desired brightness.

The above-described (step 1) is included in the write processing period, (step 12) and (step 13) are included in the compensation processing period, and (step 14) corresponds to the light emission period.

Next, a threshold compensation operation according to the present embodiment will be described in detail.

The potential V1 of the node $N_A$ according to the input data (Vdata) is represented by an equation (15).

$$V1 = V\text{data} \tag{15}$$

The potential of the node $N_B$ is represented as the potential V2 in an equation (16).

$$V2 = VDD - Vth \tag{16}$$

In the above-described equation (16), Vth is a threshold of the transistor 43.

Here, in a case in which a state is transitioned from step 12 to step 13 according to the present embodiment, if, when the signal sCV is transitioned to an H level, quantities of electric charges which are respectively accumulated in the node $N_A$ and the node $N_C$ are referred to as Q1 and Q3, the following equation (17) is derived.

$$\begin{aligned} Q1 &= V1 \times C1 = Vdata \times C1 Q3 = (V3 - VDD) \times C2 \times C3/(C2 + C3) \\ &= (VDD - VDD) \times C2 \times C3/(C2 + C3) \\ &= 0 \end{aligned} \tag{17}$$

As derived from the above-described equation (17), in a case in which a state is transitioned from the step 12 to step 13, immediately after the signal sCV is transitioned to an H level, the potential (V3) of the node $N_C$ goes to VDD, and thereby an electric charge Q3 can be regarded as zero.

In addition, the signal sTRN is retained as an L level in step 13, and thereby the capacitors C2 and C3 which are coupled in series to the capacitor C1 via the transistor 42 are configured so as to be coupled in parallel to each other. The quantities of electric charges (Q1 and Q3) which are accumulated in the respective capacitors are retained, and thus, if the potential of the node $N_C$ becomes V3, thereby being stable, a relationship which is represented by an equation (18) is derived.

$$Q1+Q3=V\text{data}\times C1+0=V3\times C1+(V3-VDD)\times C2\times C3/(C2+C3) \quad (18)$$

If the above-described equation (18) is organized with regard to the potential V3, the following equation (19) is derived.

$$V3=(V\text{data}\times C1+VDD\times C2\times C3/(C2+C3))/(C1+C2\times C3/(C2+C3)) \quad (19)$$

Here, the potential V2 of the node $N_B$ is affected by a potential change of the potential V3 of the node $N_C$.

The potential V2 in which affection of a potential change is considered is represented by an equation (20).

$$V2=((V3-VDD)\times C2/(C2+C3)+VDD-Vth=Vcd-Vth \quad (20)$$

Next, a drive current IL of the light emission element 49 is represented by an equation (21).

$$IL=\tfrac{1}{2}\beta(VDD-V2-Vth)^2 \quad (21)$$

In the equation (21), β represents a coefficient, and Vth is a threshold of the transistor 43. If the equation (20) is applied to the equation (21), the drive current IL can be represented by an equation (22).

$$IL=\tfrac{1}{2}\beta(VDD-Vcd+Vth-Vth)^2=\tfrac{1}{2}\beta(VDD-Vcd)^2 \quad (22)$$

As represented by the equation (22), the drive current IL has no term depending on the threshold Vth, and thus the drive current can be derived without being affected by the threshold.

In the embodiment described above, a display device secures a write processing period and a compensation processing period, thereby being able to easily control an amount of light of a light emission element.

Figure 8:
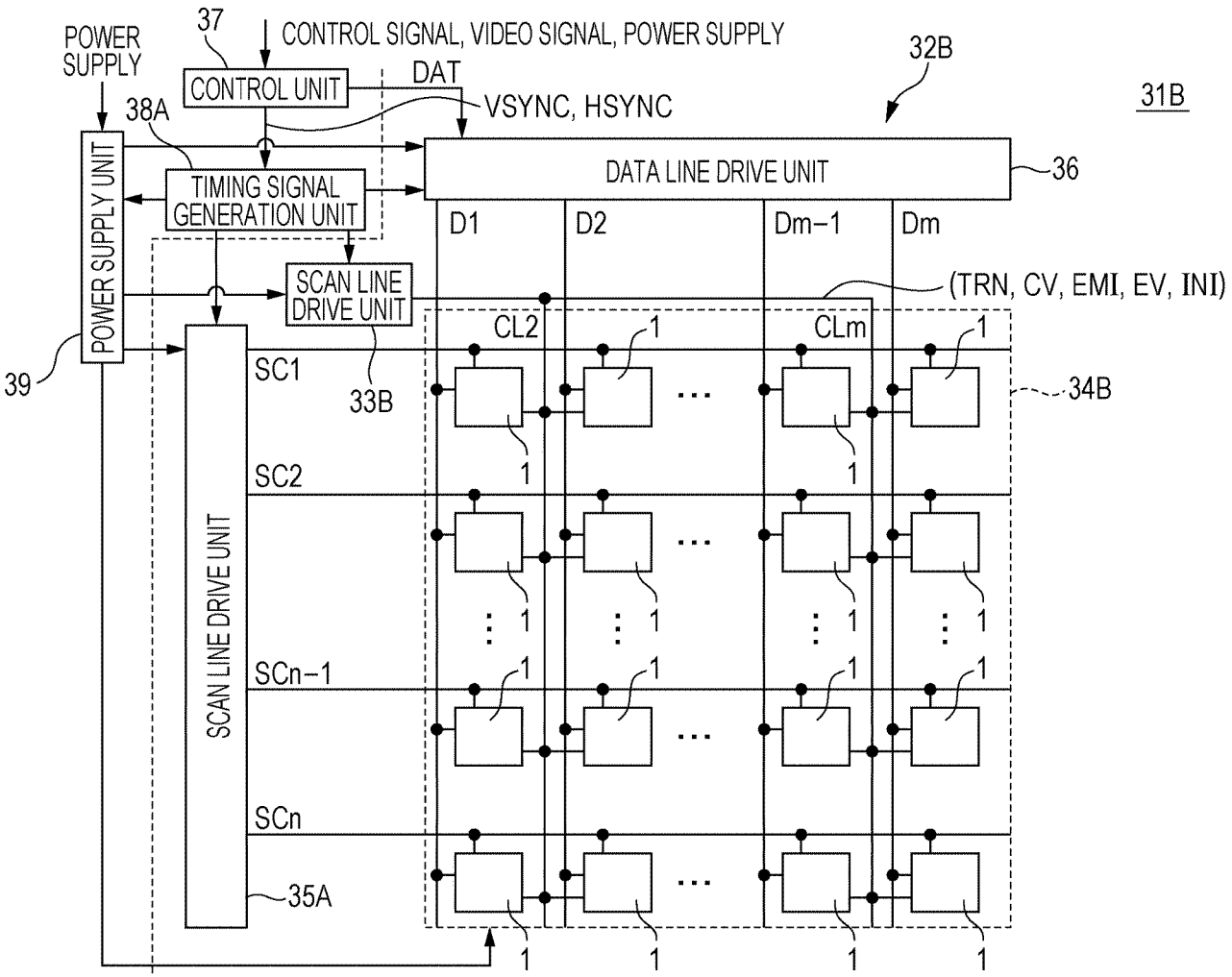
FIG. 8 is a block diagram of a display device according to the present embodiment.

FIG. 8 is a block diagram of a display device according to the present embodiment. A display device 31B illustrated in FIG. 8 is configured to include a display panel 32B, a control unit 37, a timing signal generation unit 38A, and a power supply unit 39.

The display panel 32B of the display device 31B illustrated in FIG. 8 is different from that of the display device 31A illustrated in FIG. 3 according to the first embodiment.

The display panel 32B is configured to include a display unit 34B which includes pixel units 1 that are arranged in a matrix, scan line drive units 33B and 35A which drive the respective pixel units 1, and a data line drive unit 36.

The display unit 34B and the scan line drive unit 33B of the display panel 32B illustrated in FIG. 8 is different from that of the display panel 32A illustrated in FIG. 3 previously described.

In the display unit 34B according to the present embodiment, a set of control lines CL2 to CLm is further provided in an extending direction of the data signal lines D1 to Dm. In a case of the present embodiment, the set of control lines CL is provided in each of two data signal lines, and thereby the total numbers of the set of control lines CL2 to CLm are half the number (m) of the data signal lines D1 to Dm. In a case of the present embodiment, for example, a control line TRN, a control line CV, a control line EMI, a control line EV, and a control line INI are included in the set of control lines CL. The data signal lines D1 to Dm transfer input data which is written to the retention units 2 of a plurality of pixels, during a vertical scan period in which the plurality of pixel units 1 is sequentially scanned.

By doing this, during a predetermined period which is determined within the vertical scan period, a range in which compensation processing of compensating values of drive currents is collectively performed on the plurality of pixels is determined. The set of control lines CL2 to CLn supplies the same control signal for the pixel units 1 of the range in which the compensation processing is collectively performed.

A control signal for compensating processing and a light emission control is supplied by the set of control lines CL2 to CLn, according to the set of scan lines.

For example, an area in which the set of control line CL2 is wired is provided between two pixel units 1 to which the data signal lines D1 and D2 are respectively coupled. In this way, a wiring area is provided between a set of two pixel units 1 corresponding to each other, and thereby wiring from the set of control line CL2 to the pixel unit 1 which is coupled to the data signal line D1, and wiring from the set of control line CL2 to the pixel unit 1 which is coupled to the data signal line D2 can be efficiently performed, and it is possible to reduce a wiring area. It is assumed that wiring areas are provided from the set of control lines CL4 to CLm in the same manner.

In this way, a control line which transfers a control signal for compensation processing and a light emission control is provided in each of two data signal lines, and thereby it is possible to obtain an effect in which a wiring area can be reduced.

Furthermore, a scan line is generally wired by a metal with a high resistance, but there are many cases in which a data signal line is wired by a metal with a low resistance. As described above, wiring is performed in parallel with the data signal line, and thereby wiring can be performed using a metal with a low resistance, and there is an effect in which a wiring resistance is decreased.

The scan line drive unit 33B includes a driver circuit which drives the set of control lines CL. The scan line drive unit 33B supplies various control signals to the set of control lines CL2 to CLm which are provided in an extending direction of the data signal lines D1 to Dm.

In the present embodiment described above, the display device 31B (display panel 32B) secures a write processing period and a compensation processing period, thereby being able to easily control an amount of light of a light emission element.

Third Embodiment

Figure 9:
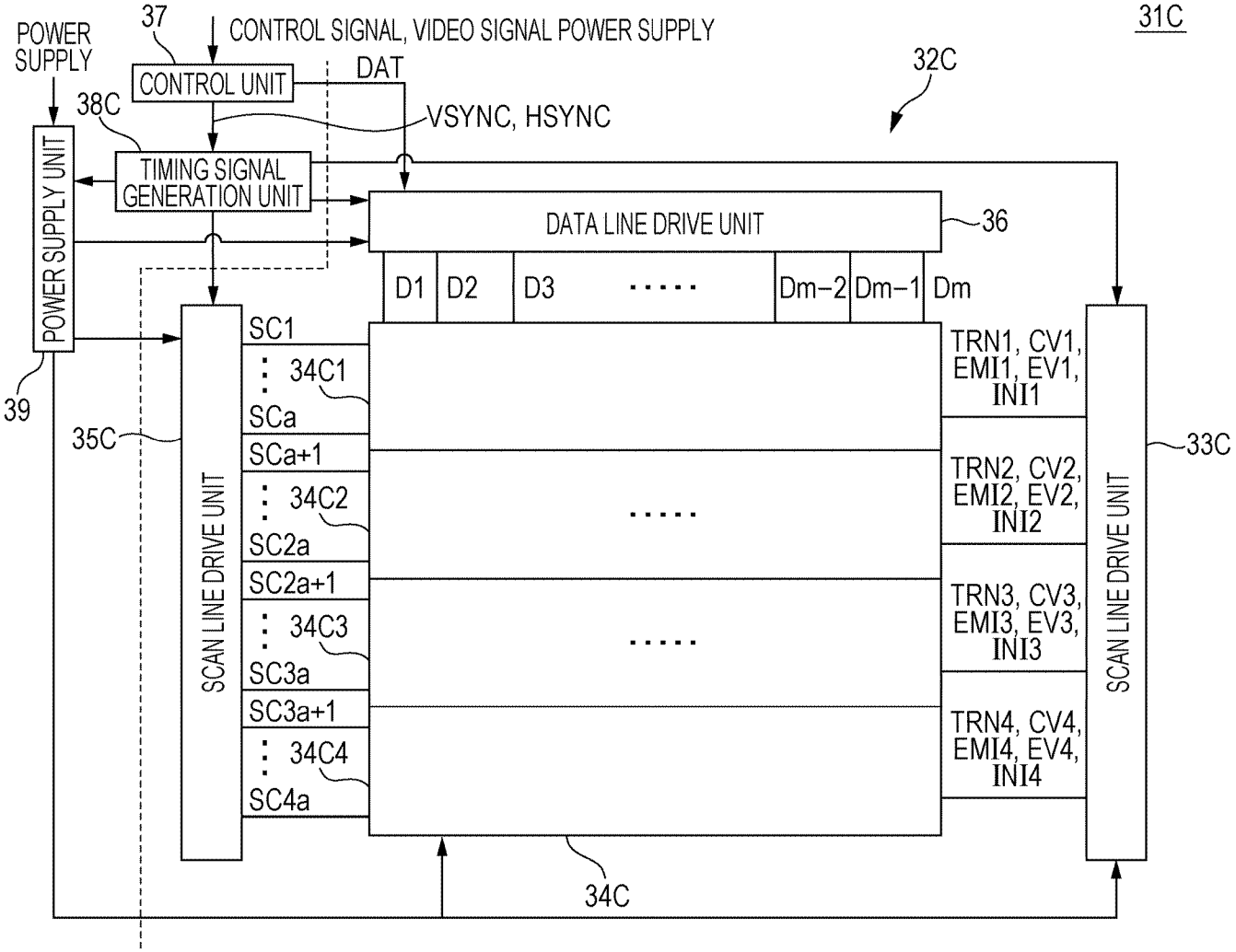
FIG. 9 is a block diagram illustrating a display device according to a third embodiment.

FIG. 9 is a block diagram illustrating a display device according to the present embodiment.

A display device 31C illustrated in FIG. 9 is configured to include a display panel 32C, a control unit 37, a timing signal generation unit 38C, and a power supply unit 39.

The display panel 32C and the timing signal generation unit 38C of the display device 31C illustrated in FIG. 9 are different from those of the display device 31A illustrated in FIG. 3 according to the first embodiment.

The display panel 32C is configured to include a display unit 34C which includes pixel units 1 that are arranged in a matrix, scan line drive units 33C and 35C which drive the respective pixel units 1, and a data line drive unit 36.

The display unit 34C and the scan line drive units 33C and 35C of the display panel 32C illustrated in FIG. 9 are different from those of the display panel 32A illustrated in FIG. 3 which is previously described.

In the display unit 34C according to the present embodiment, a plurality of pixel units 1 is arranged in a matrix, but furthermore the pixel units are divided into a plurality of areas. For example, as illustrated in FIG. 9, the pixel units are divided into four areas (areas 34C1 to 34C4).

Control signals for compensation processing in which a value of a drive current is generated and light emission control are independently supplied to each of the divided areas 34C1 to 34C4.

For example, a signal sTRN1, a signal sCV1, a signal sEMI1, a signal sEV1, and a signal sINI1 are supplied to the area 34C1 via the scan line drive unit 33C. A signal sTRN2, a signal sCV2, a signal sEMI2, a signal sEV2, and a signal sINI2 are supplied to the area 34C2 via the scan line drive unit 33C. A signal sTRN3, a signal sCV3, a signal sEMI3, a signal sEV3, and a signal sINI3 are supplied to the area 34C3 via the scan line drive unit 33C. A signal sTRN4, a signal sCV4, a signal sEMI4, a signal sEV4, and a signal sINI4 are supplied to the area 34C4 via the scan line drive unit 33C.

The signals sTRN1 to sTRN4 correspond to the signal sTRN which is described with regard to the first and second embodiments. The signals sCV1 to sCV4 correspond to the signal sCV in the same manner. The signals sEMI1 to sEMI4 correspond to the signal sEMI in the same manner. The signals sEV1 to sEV4 correspond to the signal sEV in the same manner. The signals sINI1 to sINI4 correspond to the signal sINI described above.

In addition, as described above, an area at which the pixel units 1 are provided is divided into four areas, and thereby the scan line drive unit 33C outputs respective scan signals having different timings from each other by a predetermined interval to the respective areas, in synchronization with a timing signal which is supplied from the timing signal generation unit 38C.

The signals sSC1 to sSCa are supplied to the area 34C1 via the scan line drive unit 35C. The signals sSCa+1 to sSC2*a* are supplied to the area 34C2 via the scan line drive unit 35C. The signals sSC2*a*+1 to sSC3*a* are supplied to the area 34C3 via the scan line drive unit 35C. The signals sSC3*a*+1 to sSC4*a* are supplied to the area 34C4 via the scan line drive unit 35C.

The signals sSC1 to sSCa, the signals sSCa+1 to sSC2*a*, the signals sSC2*a*+1 to sSC3*a*, and the signals sSC3*a*+1 to sSC4*a* correspond to the signals sSC1 to sSCn which are described with regard to the first and second embodiments, and it is different from the first and second embodiments in that a supply destination is divided for each area.

In the same manner, the scan lines SC1 to SCa, the scan lines SCa+1 to SC2*a*, the scan lines SC2*a*+1 to SC3*a*, and the scan lines SC3*a*+1 to SC4*a* correspond to the scan lines SC1 to SCn which are described with regard to the first and second embodiments, and it is different from the first and second embodiments in that a supply destination is divided for each area.

Next, a display control of a display unit according to the present embodiment will be described with reference to FIG. 10.

Figure 10:
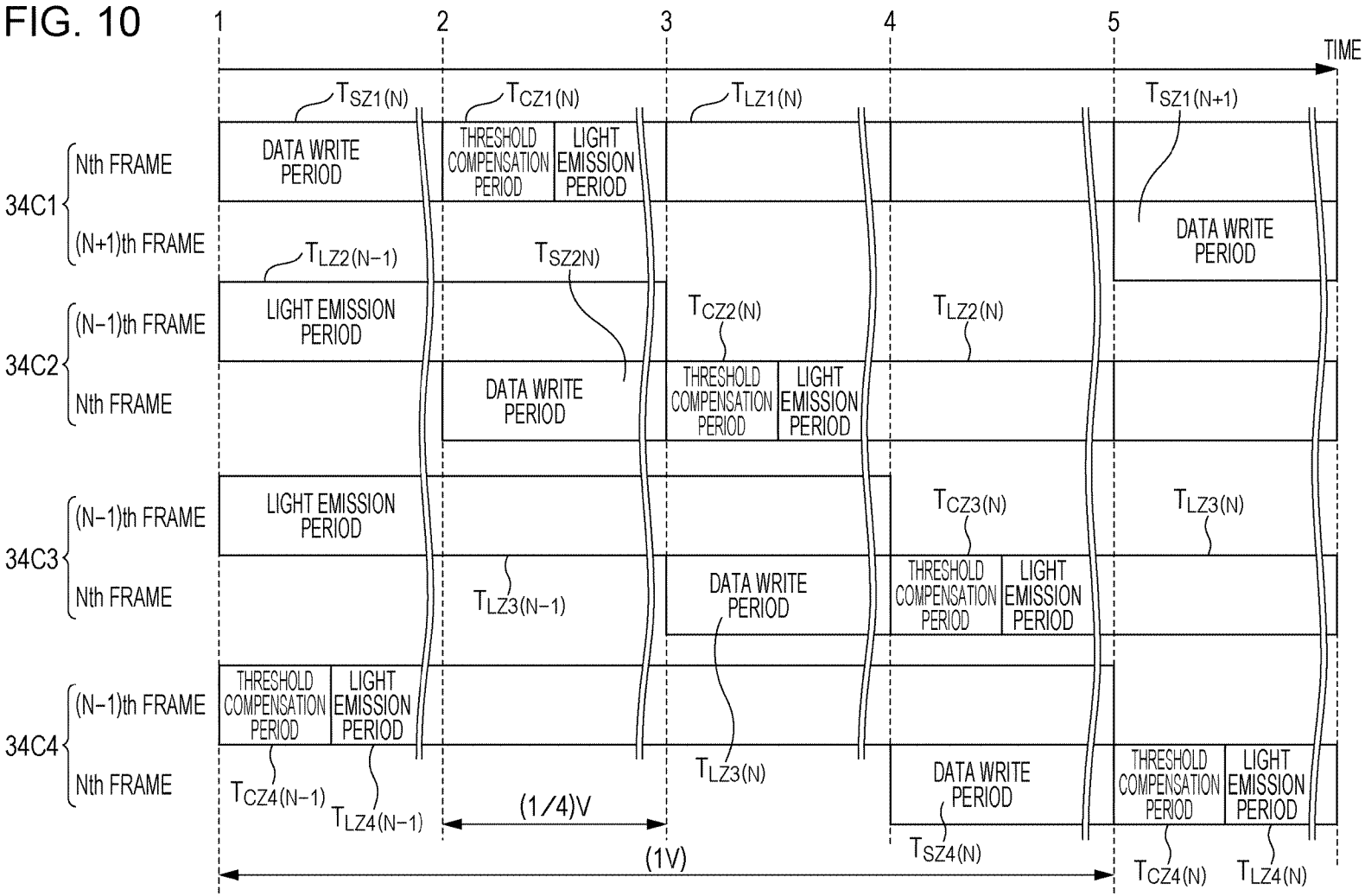
FIG. 10 is a timing diagram illustrating a drive of a pixel unit according to the present embodiment.

FIG. 10 is a timing diagram illustrating a display control of a display unit according to the present embodiment.

In FIG. 10, a timing of a control in which video signals of three frames from an (N−1)th frame to an (N+1)th frame are displayed on the pixel unit is illustrated, in correspondence to four areas.

Processing of the respective frames is divided into three periods which are illustrated later, and are performed. The three periods are a write processing period, a compensation processing period, and a light emission period, in the same manner as in FIG. 2.

In addition, the processing which is performed by the frame unit is performed in a sequence of a write processing period, a compensation processing period, and a light emission period. For example, in a case of the Nth frame in the area 34C1, processing is performed in a sequence of a write processing period $T_{SZ1}(N)$, a compensation processing period $T_{CZ1}(N)$, and a light emission period $T_{LZ1}(N)$. In the same manner, in a case of the (N+1)th frame, processing is performed in a sequence of a write processing period $T_{SZ1}(N+1)$, a compensation processing period $T_{CZ1}(N+1)$, and a light emission period $T_{LZ1}(N+1)$.

In a case of the (N−1)th frame in the area 34C2, processing is performed in a sequence of a write processing period $T_{SZ2}(N-1)$, a compensation processing period $T_{CZ2}(N-1)$, and a light emission period $T_{LZ2}(N-1)$. In the same manner, in a case of the Nth frame, processing is performed in a sequence of a write processing period $T_{SZ2}(N)$, a compensation processing period $T_{CZ2}(N)$, and a light emission period $T_{LZ2}(N)$.

In a case of the (N−1)th frame in the area 34C3, processing is performed in a sequence of a write processing period $T_{SZ3}(N-1)$, a compensation processing period $T_{CZ3}(N-1)$, and a light emission period $T_{LZ3}(N-1)$. In the same manner, in a case of the Nth frame, processing is performed in a sequence of a write processing period $T_{SZ3}(N)$, a compensation processing period $T_{CZ3}(N)$, and a light emission period $T_{LZ3}(N)$.

In a case of the (N−1)th frame in the area 34C4, processing is performed in a sequence of a write processing period $T_{SZ4}(N-1)$, a compensation processing period $T_{CZ4}(N-1)$, and a light emission period $T_{LZ4}(N-1)$. In the same manner, in a case of the Nth frame, processing is performed in a sequence of a write processing period $T_{SZ4}(N)$, a compensation processing period $T_{CZ4}(N)$, and a light emission period $T_{LZ4}(N)$.

Here, the write processing period of the Nth frame will be considered. In the write processing period of the Nth frame, if the processing is arranged in a sequence of processing, the write processing period $T_{SZ1}(N)$ of the area 34C1, the write processing period $T_{SZ2}(N)$ of the area 34C2, the write processing period $T_{SZ3}(N)$ of the area 34C3, and the write processing period $T_{SZ4}(N)$ of the area 34C4 are sequentially arranged.

Since the area is divided into four areas, a length of each write processing period is (¼) V of a vertical scan period. In short, a total length of the four write processing periods becomes a vertical scan period (1V).

In this way, a scan is sequentially performed in SC1 to SC4*a*, and a threshold compensation and a light emission control are collectively performed at the time of writing data to a pixel unit of each area.

In addition, control signals for compensation processing and a light emission control in which a value of a drive current is generated are independently supplied to each of the areas 34C1 to areas 34C4 which are divided, and thereby a control can be performed as illustrated in the above-described timing chart.

Compared to a case in which input data is retained during a vertical scan period (1V) and thereby a threshold compensation is performed, during the time in which the retention unit 2 retains the input data, a time difference between pixels of the whole screen is decreased, by dividing an area as described in the present embodiment. By doing this, it is possible to suppress that a voltage (voltage (V1) of the node $N_A$) which is retained in the retention unit 2 is affected by a leakage current.

In addition, since a threshold compensation and data writing can be simultaneously performed between other areas, substantially all the vertical scan periods (1V) can be assigned to the write processing period, and thus it is possible to lengthen data writing time which can be assigned per unit pixel.

Furthermore, a threshold compensation time of each horizontal scan period can be reduced, and threshold compensation can be collectively performed at a certain timing of a vertical scan period. In addition, since a retention unit and a light emission control unit are separated from each other, data writing can be performed, while light is emitted.

The display device (display panel, drive circuit) which is described in the respective embodiments can easily control an amount of light of a light emission element.

Conditions of the embodiments described above can be appropriately modified within a range without being affected by technical characteristics of the invention. In addition, there is also a case in which a portion of the configuration elements is not used.

REFERENCE SIGNS LIST

1 pixel unit
2 retention unit
4 light emission control unit

The invention claimed is:

1. A display device of an active scan type in which a plurality of pixels are arranged in a matrix, further comprising:

multiple pairs of a retention unit retaining input data which is supplied and a light emission control unit compensating a value of a drive current that flows to a light emission element based on the input data which is retained in the retention unit; wherein the light emission control unit compensates the value of the drive current that flows to the light emission element after the retention unit retains the input data, a write processing period in which the input data is retained in the retention unit overlaps a period in which the light emission control unit drives the light emission element, the input data is written to the retention unit by write processing, the input data representing a brightness of a pixel that is adjusted by the light emission control unit, the display device further includes:

a scan signal line transmitting a first control signal to the pixel, the first control signal controlling the retention unit by sequentially scanning a plurality of pixels during a vertical scan period in which the plurality of pixels are sequentially scanned; and a control line transmitting a second control signal to the pixel included in a range in which a compensation processing of compensating a value of the drive current is collectively performed in the light emission control unit for the plurality of pixels, for each set of a pair of two scan signal lines along an extending direction of the scan signal line, during a predetermined period which is determined within the vertical scan period, the second control signal being related to the compensation processing and a light emission control; and the second control signal is supplied according to the set of the scan signal lines.

2. The display device according to claim 1, wherein an area of a display unit in which the plurality of pixels are provided is divided into a plurality of areas, and wherein a second control signal is independently supplied to each of the divided areas, the second control signal being related to a compensation processing of generating the value of the drive current and a light emission control.

3. The display device according to claim 1, wherein the retention unit retains the input data during a light emission period in which the light emission element emits light based on the input data that forms an image of a first frame, the input data forming an image of a second frame following the first frame.

4. The drive circuit according to claim 1, further comprising a compensation processing period, a plurality of light emission control units respectively compensating the value of the drive current during the compensation processing period, wherein the write processing period and the compensation processing period are separately provided, a plurality of the retention units retaining the input data during the write processing period.

5. The drive circuit according to claim 4, wherein the plurality of light emission control units collectively perform processing of compensating a value of each drive current.

6. The drive circuit according to claim 4, wherein the plurality of light emission control units control such that the respective compensation processing periods coincide with each other.

7. The drive circuit according to claim 4, wherein the write processing period overlaps the driving period, the input data being retained in the plurality of retention units during the write processing period, the plurality of light emission control units driving the light emission element during the driving period.

8. The drive circuit according to claim 4, wherein the plurality of retention units are provided in association with different horizontal scan signal lines.

9. The drive circuit according to claim 4, the retention unit comprising:

a sampling switch outputting a voltage according to the input data which represents an amount of light of the light emission element at a predetermined timing which is determined; and a first capacitor retaining the voltage which is output from the sampling switch, wherein the light emission control unit compensates the value of the drive current based on the voltage which is retained in the first capacitor, as the retained input data.

10. A display device of an active scan type in which a plurality of pixels are arranged in a matrix, comprising:

multiple pairs of a retention unit retaining input data which is supplied and a light emission control unit compensating a value of a drive current that flows to a light emission element based on the input data which is retained in the retention unit; wherein the light emission control unit compensates the value of the drive current that flows to the light emission element after the retention unit retains the input data, a write processing period in which the input data is retained in the retention unit overlaps a period in which the light emission control unit drives the light emission element, the input data is written to the retention unit by write processing, the input data representing a brightness of a pixel that is adjusted by the light emission control unit, the display device further includes:

a data signal line transmitting the input data to the pixel, the input data being written to the retention unit of the plurality of pixels during a vertical scan period in which the plurality of pixels are sequentially scanned; and a control line transmitting a second control signal to the pixel included in a range in which a compensation processing of compensating a value of the drive current is collectively performed in the light emission control unit for the plurality of pixels during a predetermined period which is determined within the vertical scan period, the second control signal being related to the compensation processing and a light emission control for each set of a pair of two data signal lines along an extending direction of the data signal line; and the second control signal is supplied according to the set of the data signal lines.

11. The display device according to claim 10, wherein an area of a display unit in which the plurality of pixels are provided is divided into a plurality of areas, and wherein a second control signal is independently supplied to each of the divided areas, the second control signal being related to a compensation processing of generating the value of the drive current and a light emission control.

12. The display device according to claim 10, wherein the retention unit retains the input data during a light emission period in which the light emission element emits light based on the input data that forms an image of a first frame, the input data forming an image of a second frame following the first frame.

13. The drive circuit according to claim 10, further comprising a compensation processing period, a plurality of light emission control units respectively compensating the value of the drive current during the compensation processing period, wherein the write processing period and the compensation processing period are separately provided, a plurality of the retention units retaining the input data during the write processing period.

14. A display device of an active scan type in which a plurality of pixels are arranged in a matrix, comprising:

multiple pairs of a retention unit retaining input data which is supplied and a light emission control unit compensating a value of a drive current that flows to a light emission element based on the input data which is retained in the retention unit; wherein the light emission control unit compensates the value of the drive current that flows to the light emission element after the retention unit retains the input data, a write processing period in which the input data is retained in the retention unit overlaps a period in which the light emission control unit drives the light emission element, the input data is written to the retention unit by write processing, the input data representing a brightness of a pixel that is adjusted by the light emission control unit, a third control signal is supplied in a predetermined period which is determined within a vertical scan period in which the plurality of pixels are sequentially scanned, the third control signal providing a compensation processing period in which a compensation processing of generating a value of the drive current is collectively performed in the light emission control unit for the plurality of pixels, the light emission control unit includes a drive unit which drives the light emission element, and the light emission control unit compensates the value of the drive current according to threshold characteristics of the drive unit during the compensation processing period, according to the third control signal which provides the compensation processing period.

15. The display device according to claim 14, wherein a fourth control signal is supplied during the vertical scan periods in which the plurality of pixels are sequentially scanned, the fourth control signal providing a write processing period in which the supplied input data is retained in the retention unit and the compensation processing period in which the values of the drive currents are respectively compensated in different periods, and wherein the retention unit retains the supplied input data during the write processing period, according to the fourth control signal which provides the write processing period and the compensation processing period in the different periods.

16. The display device according to claim 15, wherein a fifth control signal in which the write processing period is included in a light emission period in which the light emission element emits light is supplied, and wherein the light emission control unit makes the light emission element emit light during the light emission period, according to the fifth control signal in which the write processing period is included in the light emission period in which the light emission element emits light.

17. The display device according to claim 15, wherein the light emission control unit includes a field effect transistor which adjusts the drive current, and a second capacitor which is coupled to a gate terminal of the field effect transistor, and wherein the light emission control unit discharges an electric charge during the period from the write processing period to the compensation processing period, the electric charge being accumulated in the second capacitor which is coupled to the gate terminal of the field effect transistor.

18. The display device according to claim 15, further comprising:

a timing signal generation unit generating the third control signal.

19. The display device according to claim 18, wherein the timing signal generation unit generates the fourth control signal.

20. The display device according to claim 18, wherein the timing signal generation unit generates a fifth control signal that controls such that the write processing period is included in a light emission period in which the light emission element emits light.

* * * * *